US010777154B2

(12) United States Patent
Huang

(10) Patent No.: US 10,777,154 B2
(45) Date of Patent: Sep. 15, 2020

(54) DRIVING METHOD AND DRIVING DEVICE FOR DISPLAY PANEL, AND DISPLAY DEVICE

(71) Applicant: HKC Corporation Limited, Shenzhen (CN)

(72) Inventor: Bei Zhou Huang, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 24 days.

(21) Appl. No.: 16/161,764

(22) Filed: Oct. 16, 2018

(65) Prior Publication Data

US 2019/0189072 A1 Jun. 20, 2019

Related U.S. Application Data

(63) Continuation of application No. PCT/CN2018/097933, filed on Aug. 1, 2018.

(30) Foreign Application Priority Data

Dec. 18, 2017 (CN) ..... 2017 1 1365856

(51) Int. Cl.
*G09G 3/36* (2006.01)

(52) U.S. Cl.
CPC ..... *G09G 3/3614* (2013.01); *G09G 3/3607* (2013.01); *G09G 2300/0452* (2013.01)

(58) Field of Classification Search
CPC ..... G09G 2310/0235; G09G 3/3614; G09G 3/2074
See application file for complete search history.

(56) References Cited

U.S. PATENT DOCUMENTS

2015/0161927 A1* 6/2015 Hekstra ..... G09G 3/3614 345/209
2016/0306246 A1* 10/2016 Kum ..... G02F 1/13624
2017/0116934 A1* 4/2017 Tien ..... G09G 3/364
2018/0114478 A1* 4/2018 Tien ..... G09G 3/3614
2019/0043434 A1* 2/2019 Chen ..... G09G 3/3614

* cited by examiner

*Primary Examiner* — Yuzhen Shen
(74) *Attorney, Agent, or Firm* — WPAT, PC

(57) ABSTRACT

The disclosure relates to a driving method and a driving device for a display panel and a display device, wherein the display panel includes a plurality of first pixel units and a plurality of second pixel units which are disposed adjacently. The driving method includes dividing a plurality of pixel units of the display panel into a plurality of pixel unit groups; driving subpixels in first pixel units and subpixels in second pixel units by using drive voltages of different voltage levels; driving the subpixels arranged in the same line in every two adjacent pixel unit groups by using the drive voltages of opposite polarities; and driving every continuously arranged four lines of pixel units in the same one of the pixel unit groups by using the drive voltages of different polarities.

3 Claims, 9 Drawing Sheets

20

| | C11 | | C12 | | C13 | | C14 | | C15 | | C16 | |
|---|---|---|---|---|---|---|---|---|---|---|---|---|
| n | R1 H+ (i, j) | G1 H+ (i, j) | B1 H− (i, j) | R2 L− (i, j+1) | G2 L+ (i, j+1) | B2 L+ (i, j+1) | R1 H− (i, j+2) | G1 H− (i, j+2) | B1 H+ (i, j+2) | R2 L+ (i, j+3) | G2 L− (i, j+3) | B2 L− (i, j+3) |
| | R2 L+ (i+1, j) | G2 L+ (i+1, j) | B2 L− (i+1, j) | R1 H− (i+1, j+1) | G1 H+ (i+1, j+1) | B1 H+ (i+1, j+1) | R2 L− (i+1, j+2) | G2 L− (i+1, j+2) | B2 L+ (i+1, j+2) | R1 H+ (i+1, j+3) | G1 H− (i+1, j+3) | B1 H− (i+1, j+3) |
| n+1 | R1 H− (i+2, j) | G1 H− (i+2, j) | B1 H+ (i+2, j) | R2 L+ (i+2, j+1) | G2 L− (i+2, j+1) | B2 L− (i+2, j+1) | R1 H+ (i+2, j+2) | G1 H+ (i+2, j+2) | B1 H− (i+2, j+2) | R2 L− (i+2, j+3) | G2 L+ (i+2, j+3) | B2 L+ (i+2, j+3) |
| | R2 L− (i+3, j) | G2 L− (i+3, j) | B2 L+ (i+3, j) | R1 H+ (i+3, j+1) | G1 H− (i+3, j+1) | B1 H− (i+3, j+1) | R2 L+ (i+3, j+2) | G2 L+ (i+3, j+2) | B2 L− (i+3, j+2) | R1 H− (i+3, j+3) | G1 H+ (i+3, j+3) | B1 H+ (i+3, j+3) |
| | C21 | | C22 | | C23 | | C24 | | C25 | | C26 | |

20

| | | | | | | |
|---|---|---|---|---|---|---|
| n | P1(i, j)<br>H | P2(i, j+1)<br>L | P1(i, j+2)<br>H | P2(i, j+3)<br>L | P1(i, j+4)<br>H | P2(i, j+5)<br>L |
| | P2(i+1, j)<br>L | P1(i+1, j+1)<br>H | P2(i+1, j+2)<br>L | P1(i+1, j+3)<br>H | P2(i+1, j+4)<br>L | P1(i+1, j+5)<br>H |
| n+1 | P1(i+2, j)<br>H | P2(i+2, j+1)<br>L | P1(i+2, j+2)<br>H | P2(i+2, j+3)<br>L | P1(i+4, j+4)<br>H | P2(i+4, j+5)<br>L |
| | P2(i+3, j)<br>L | P1(i+3, j+1)<br>H | P2(i+3, j+2)<br>L | P1(i+2, j+3)<br>H | P2(i+5, j+4)<br>L | P1(i+4, j+5)<br>H |

20

| | C11 | | C12 | | C13 | | C14 | | C15 | | C16 | |
|---|---|---|---|---|---|---|---|---|---|---|---|---|
| n | R1<br>H+<br>(i, j) | G1<br>H+<br>(i, j) | B1<br>H−<br>(i, j) | R2<br>L−<br>(i, j+1) | G2<br>L+<br>(i, j+1) | B2<br>L+<br>(i, j+1) | R1<br>H−<br>(i, j+2) | G1<br>H−<br>(i, j+2) | B1<br>H+<br>(i, j+2) | R2<br>L+<br>(i, j+3) | G2<br>L−<br>(i, j+3) | B2<br>L−<br>(i, j+3) |
| | R2<br>L+<br>(i+1, j) | G2<br>L+<br>(i+1, j) | B2<br>L−<br>(i+1, j) | R1<br>H−<br>(i+1, j+1) | G1<br>H+<br>(i+1, j+1) | B1<br>H+<br>(i+1, j+1) | R2<br>L−<br>(i+1, j+2) | G2<br>L−<br>(i+1, j+2) | B2<br>L+<br>(i+1, j+2) | R1<br>H+<br>(i+1, j+3) | G1<br>H−<br>(i+1, j+3) | B1<br>H−<br>(i+1, j+3) |
| n+1 | R1<br>H−<br>(i+2, j) | G1<br>H−<br>(i+2, j) | B1<br>H+<br>(i+2, j) | R2<br>L+<br>(i+2, j+1) | G2<br>L−<br>(i+2, j+1) | B2<br>L−<br>(i+2, j+1) | R1<br>H+<br>(i+2, j+2) | G1<br>H+<br>(i+2, j+2) | B1<br>H−<br>(i+2, j+2) | R2<br>L−<br>(i+2, j+3) | G2<br>L+<br>(i+2, j+3) | B2<br>L+<br>(i+2, j+3) |
| | R2<br>L−<br>(i+3, j) | G2<br>L−<br>(i+3, j) | B2<br>L+<br>(i+3, j) | R1<br>H+<br>(i+3, j+1) | G1<br>H−<br>(i+3, j+1) | B1<br>H−<br>(i+3, j+1) | R2<br>L+<br>(i+3, j+2) | G2<br>L+<br>(i+3, j+2) | B2<br>L−<br>(i+3, j+2) | R1<br>H−<br>(i+3, j+3) | G1<br>H+<br>(i+3, j+3) | B1<br>H+<br>(i+3, j+3) |
| | C21 | | C22 | | C23 | | C24 | | C25 | | C26 | |

FIG. 3

20

| | | | | | | | | | | | | |
|---|---|---|---|---|---|---|---|---|---|---|---|---|
| n | R1<br>H−<br>(i, j) | G1<br>H−<br>(i, j) | B1<br>H+<br>(i, j) | R2<br>L+<br>(i, j+1) | G2<br>L−<br>(i, j+1) | B2<br>L−<br>(i, j+1) | R1<br>H+<br>(i, j+2) | G1<br>H+<br>(i, j+2) | B1<br>H−<br>(i, j+2) | R2<br>L−<br>(i, j+3) | G2<br>L+<br>(i, j+3) | B2<br>L+<br>(i, j+3) |
| | R2<br>L−<br>(i+1, j) | G2<br>L−<br>(i+1, j) | B2<br>L+<br>(i+1, j) | R1<br>H+<br>(i+1, j+1) | G1<br>H−<br>(i+1, j+1) | B1<br>H−<br>(i+1, j+1) | R2<br>L+<br>(i+1, j+2) | G2<br>L+<br>(i+1, j+2) | B2<br>L−<br>(i+1, j+2) | R1<br>H−<br>(i+1, j+3) | G1<br>H+<br>(i+1, j+3) | B1<br>H+<br>(i+1, j+3) |
| n+1 | R1<br>H+<br>(i+2, j) | G1<br>H+<br>(i+2, j) | B1<br>H−<br>(i+2, j) | R2<br>L−<br>(i+2, j+1) | G2<br>L+<br>(i+2, j+1) | B2<br>L+<br>(i+2, j+1) | R1<br>H−<br>(i+2, j+2) | G1<br>H−<br>(i+2, j+2) | B1<br>H+<br>(i+2, j+2) | R2<br>L+<br>(i+2, j+3) | G2<br>L−<br>(i+2, j+3) | B2<br>L−<br>(i+2, j+3) |
| | R2<br>L+<br>(i+3, j) | G2<br>L+<br>(i+3, j) | B2<br>L−<br>(i+3, j) | R1<br>H−<br>(i+3, j+1) | G1<br>H+<br>(i+3, j+1) | B1<br>H+<br>(i+3, j+1) | R2<br>L−<br>(i+3, j+2) | G2<br>L−<br>(i+3, j+2) | B2<br>L+<br>(i+3, j+2) | R1<br>H+<br>(i+3, j+3) | G1<br>H−<br>(i+3, j+3) | B1<br>H−<br>(i+3, j+3) |

FIG. 4

| | | | | | | | | | | | |
|---|---|---|---|---|---|---|---|---|---|---|---|
| R1 H+ | G1 H+ | B1 H− | R2 L− | G2 L+ | B2 L+ | R1 H− | G1 H− | B1 H+ | R2 L+ | G2 L− | B2 L− |
| R2 L+ | G2 L+ | B2 L− | R1 H− | G2 H+ | B1 H+ | R2 L− | G2 L− | B2 L+ | R1 H+ | G1 H− | B1 H− |
| R1 H− | G1 H− | B1 H+ | R2 L+ | G2 L | B2 L− | R1 H+ | G1 H+ | B1 H− | R2 L− | G2 L+ | B2 L+ |
| R2 L− | G2 L− | B2 L+ | R1 H+ | G1 H− | B1 H− | R2 L+ | G2 L+ | B2 L− | R1 H− | G1 H+ | B1 H+ |

FIG. 5a

| | | | | | | | | | | | |
|---|---|---|---|---|---|---|---|---|---|---|---|
| R1 H− | G1 H− | B1 H+ | R2 L+ | G2 L− | B2 L− | R1 H+ | G1 H+ | B1 H− | R2 L− | G2 L+ | B2 L+ |
| R2 L− | G2 L− | B2 L+ | R1 H+ | G2 H− | B1 H− | R2 L+ | G2 L+ | B2 L− | R1 H− | G1 H+ | B1 H+ |
| R1 H+ | G1 H+ | B1 H− | R2 L− | G2 L | B2 L+ | R1 H− | G1 H− | B1 H+ | R2 L+ | G2 L− | B2 L− |
| R2 L+ | G2 L+ | B2 L− | R1 H− | G1 H+ | B1 H+ | R2 L− | G2 L− | B2 L+ | R1 H+ | G1 H− | B1 H− |

FIG. 5b

| | | | | | | | | | | | |
|---|---|---|---|---|---|---|---|---|---|---|---|
| R1 H+ | G1 H+ | B1 H− | R2 L− | G2 L+ | B2 L+ | R1 H− | G1 H− | B1 H+ | R2 L+ | G2 L− | B2 L− |
| R2 L+ | G2 L+ | B2 L− | R1 H− | G2 H+ | B1 H+ | R2 L− | G2 L− | B2 L+ | R1 H+ | G1 H− | B1 H− |
| R1 H− | G1 H− | B1 H+ | R2 L+ | G2 L | B2 L− | R1 H+ | G1 H+ | B1 H− | R2 L− | G2 L+ | B2 L+ |
| R2 L− | G2 L− | B2 L+ | R1 H+ | G1 H− | B1 H− | R2 L+ | G2 L+ | B2 L− | R1 H− | G1 H+ | B1 H+ |
| R1 H+ | G1 H+ | B1 H− | R2 L− | G2 L+ | B2 L+ | R1 H− | G1 H− | B1 H+ | R2 L+ | G2 L− | B2 L− |
| R2 L+ | G2 L+ | B2 L− | R1 H− | G2 H+ | B1 H+ | R2 L− | G2 L− | B2 L+ | R1 H+ | G1 H− | B1 H− |
| R1 H− | G1 H− | B1 H+ | R2 L+ | G2 L | B2 L− | R1 H+ | G1 H+ | B1 H− | R2 L− | G2 L+ | B2 L+ |
| R2 L− | G2 L− | B2 L+ | R1 H+ | G1 H− | B1 H− | R2 L+ | G2 L+ | B2 L− | R1 H− | G1 H+ | B1 H+ |
| R1 H+ | G1 H+ | B1 H− | R2 L− | G2 L+ | B2 L+ | R1 H− | G1 H− | B1 H+ | R2 L+ | G2 L− | B2 L− |
| R2 L+ | G2 L+ | B2 L− | R1 H− | G2 H+ | B1 H+ | R2 L− | G2 L− | B2 L+ | R1 H+ | G1 H− | B1 H− |
| R1 H− | G1 H− | B1 H+ | R2 L+ | G2 L | B2 L− | R1 H+ | G1 H+ | B1 H− | R2 L− | G2 L+ | B2 L+ |
| R2 L− | G2 L− | B2 L+ | R1 H+ | G1 H− | B1 H− | R2 L+ | G2 L+ | B2 L− | R1 H− | G1 H+ | B1 H+ |
| R1 H+ | G1 H+ | B1 H− | R2 L− | G2 L | B2 L+ | R1 H− | G1 H− | B1 H+ | R2 L+ | G2 L− | B2 L− |
| R2 L+ | G2 L+ | B2 L− | R1 H− | G1 H+ | B1 H+ | R2 L− | G2 L− | B2 L+ | R1 H+ | G1 H− | B1 H− |

FIG. 5c

| | | | | | | | | | | | |
|---|---|---|---|---|---|---|---|---|---|---|---|
| R1 H+ | G1 H+ | B1 H− | R2 L− | G2 L+ | B2 L+ | R1 H− | G1 H− | B1 H+ | R2 L+ | G2 L− | B2 L− |
| R2 L+ | G2 L+ | B2 L− | R1 H− | G2 H+ | B1 H+ | R2 L− | G2 L− | B2 L+ | R1 H+ | G1 H− | B1 H− |
| R1 H− | G1 H− | B1 H+ | R2 L+ | G2 L | B2 L− | R1 H+ | G1 H+ | B1 H− | R2 L− | G2 L+ | B2 L+ |
| R2 L− | G2 L− | B2 L+ | R1 H+ | G1 H− | B1 H− | R2 L+ | G2 L+ | B2 L− | R1 H− | G1 H+ | B1 H+ |
| R1 H+ | G1 H+ | B1 H− | R2 L− | G2 L+ | B2 L+ | R1 H− | G1 H− | B1 H+ | R2 L+ | G2 L− | B2 L− |
| R2 L+ | G2 L+ | B2 L− | R1 H− | G2 H+ | B1 H+ | R2 L− | G2 L− | B2 L+ | R1 H+ | G1 H− | B1 H− |

FIG. 5d

| | | | | | | | | | | | |
|---|---|---|---|---|---|---|---|---|---|---|---|
| R1 H− | G1 H+ | B1 H− | R2 L− | G2 L+ | B2 L+ | R1 H− | G1 H− | B1 H+ | R2 L+ | G2 L− | B2 L− |
| R2 L− | G2 L+ | B2 L− | R1 H− | G2 H+ | B1 H+ | R2 L− | G2 L− | B2 L+ | R1 H+ | G1 H− | B1 H− |
| R1 H− | G1 H− | B1 H+ | R2 L+ | G2 L− | B2 L− | R1 H+ | G1 H+ | B1 H− | R2 L− | G2 L+ | B2 L+ |
| R2 L− | G2 L− | B2 L+ | R1 H+ | G1 H− | B1 H− | R2 L+ | G2 L+ | B2 L− | R1 H− | G1 H+ | B1 H+ |
| R1 H− | G1 H+ | B1 H− | R2 L− | G2 L+ | B2 L+ | R1 H− | G1 H− | B1 H+ | R2 L+ | G2 L− | B2 L− |
| R2 L− | G2 L+ | B2 L− | R1 H− | G2 H+ | B1 H+ | R2 L− | G2 L− | B2 L+ | R1 H+ | G1 H− | B1 H− |

FIG. 5e

| | | | | | | | | | | | |
|---|---|---|---|---|---|---|---|---|---|---|---|
| R1 H+ | G1 H+ | B1 H− | R2 L− | G2 L+ | B2 L+ | R1 H− | G1 H− | B1 H+ | R2 L+ | G2 L− | B2 L− |
| R2 L− | G2 L+ | B2 L− | R1 H− | G2 H+ | B1 H+ | R2 L− | G2 L− | B2 L+ | R1 H+ | G1 H− | B1 H− |
| R1 H− | G1 H− | B1 H+ | R2 L+ | G2 L− | B2 L− | R1 H+ | G1 H+ | B1 H− | R2 L− | G2 L+ | B2 L+ |
| R2 L− | G2 L− | B2 L+ | R1 H+ | G2 H− | B1 H− | R2 L+ | G2 L+ | B2 L− | R1 H− | G1 H− | B1 H+ |
| R1 H+ | G1 H+ | B1 H− | R2 L− | G2 L+ | B2 L+ | R1 H− | G1 H− | B1 H+ | R2 L+ | G2 L− | B2 L− |
| R2 L+ | G2 L+ | B2 L− | R1 H− | G2 H+ | B1 H+ | R2 L− | G2 L− | B2 L+ | R1 H+ | G1 H− | B1 H− |

FIG. 5f

| | | | | | | | | | | | |
|---|---|---|---|---|---|---|---|---|---|---|---|
| R1 H+ | G1 H+ | B1 H− | R2 L− | G2 L+ | B2 L+ | R1 H− | G1 H− | B1 H+ | R2 L+ | G2 L− | B2 L− |
| R2 L+ | G2 L+ | B2 L− | R1 H− | G2 H+ | B1 H+ | R2 L− | G2 L− | B2 L+ | R1 H+ | G1 H− | B1 H− |
| R1 H− | G1 H− | B1 H+ | R2 L+ | G2 L− | B2 L− | R1 H+ | G1 H+ | B1 H− | R2 L− | G2 L+ | B2 L+ |
| R2 L− | G2 L− | B2 L+ | R1 H+ | G2 H− | B1 H− | R2 L+ | G2 L+ | B2 L− | R1 H− | G1 H+ | B1 H+ |
| R1 H+ | G1 H+ | B1 H− | R2 L− | G2 L+ | B2 L+ | R1 H− | G1 H− | B1 H+ | R2 L+ | G2 L− | B2 L− |
| R2 L+ | G2 L+ | B2 L− | R1 H− | G2 H+ | B1 H+ | R2 L− | G2 L− | B2 L+ | R1 H+ | G1 H− | B1 H− |

FIG. 5g

| | | | | | | | | | | | |
|---|---|---|---|---|---|---|---|---|---|---|---|
| R1 H+ | G1 H+ | B1 H− | R2 L− | G2 L+ | B2 L+ | R1 H− | G1 H− | B1 H+ | R2 L+ | G2 L− | B2 L− |
| R2 L+ | G2 L+ | B2 L− | R1 H− | G2 H+ | B1 H+ | R2 L− | G2 L− | B2 L+ | R1 H+ | G1 H− | B1 H− |
| R1 H− | G1 H− | B1 H+ | R2 L+ | G2 L− | B2 L− | R1 H+ | G1 H+ | B1 H− | R2 L− | G2 L+ | B2 L+ |
| R2 L− | G2 L− | B2 L+ | R1 H+ | G2 H− | B1 H− | R2 L+ | G2 L+ | B2 L− | R1 H− | G1 H+ | B1 H+ |
| R1 H+ | G1 H+ | B1 H− | R2 L− | G2 L+ | B2 L+ | R1 H− | G1 H− | B1 H+ | R2 L+ | G2 L− | B2 L− |
| R2 L+ | G2 L+ | B2 L− | R1 H− | G2 H+ | B1 H+ | R2 L− | G2 L− | B2 L+ | R1 H+ | G1 H− | B1 H− |

FIG. 5h

DRIVING METHOD AND DRIVING DEVICE FOR DISPLAY PANEL, AND DISPLAY DEVICE

FIELD OF THE DISCLOSURE

The disclosure relates to the field of display technology, and more particularly to a driving method and a driving device for a display panel, and a display device.

BACKGROUND

In an exemplary vertical alignment (VA) liquid crystal display device, when a picture is displayed, since liquid crystal molecules keep a certain deflection angle, the transmittance of light under different viewing angles is different, as a result, a color cast phenomenon that a user will feel different colors of a picture somewhat when the user views the picture from different viewing angles is caused.

In order to improve the problem of color cast, at present, a common method is to divide the pixel electrode of RGB subpixels in each pixel unit into two independent pixel electrodes, and to apply different drive voltages to the two pixel electrodes respectively to improve the problem of color cast. Due to increase of a number of the pixel electrodes, such method needs to redesign more metal wires or thin film transistors (TFT) elements to drive the display panel, but the metal wires and the TFT elements are light-shading, thus such method will sacrifice a light transmitting aperture area, affect the transmittance of the panel and increase a backlight cost.

In order to avoid the increase of metal wires or TFT elements, another method is to apply two different high and low drive voltage signals to every adjacent two pixel units respectively. Wherein, specifically, at the same moment, the drive voltages of different polarities are applied to every adjacent two subpixels. By adopting such manner, positive and negative polarities of high voltages of the subpixels in a same row will be caused to be not matched, i.e., a number of the subpixels of positive polarity high voltage is inconsistent with a number of the subpixels of negative polarity high voltage in the same row. Hence, due to the influence of stray capacitance, when the number of the subpixels of positive polarity high voltage is more than the number of the subpixels of negative polarity high voltage in the same row, the equivalent voltage of a common voltage $V_{com}$ is improved to some extent relative to the original $V_{com}$, as a result, actually charging charges of the subpixels of positive polarity high voltage are reduced, and brightness is reduced, and oppositely, the actually charging charges of the subpixels of negative polarity high voltage are increased, and the brightness is increased, thereby further affecting display colors and picture quality and generating a problem of abnormal picture quality output.

SUMMARY

On such basis, it is necessary to provide a driving method and a driving device for a display panel and a display device, which can enable $V_{com}$ from being interfered, ensure accuracy of image signals and enhance a picture display quality.

A driving method for a display panel includes dividing a plurality of pixel units of the display panel into a plurality of pixel unit groups, wherein each of the pixel unit groups includes adjacent two rows of the pixel units; driving subpixels in first pixel units and subpixels in second pixel units by using drive voltages of different voltage levels;

driving the subpixels arranged in a same row in every adjacent two pixel unit groups by using drive voltages of opposite polarities; and driving every continuously arranged four rows of the pixel units in a same one of the pixel unit groups by using drive voltages of different polarities. Wherein each of the first pixel units and each of the second pixel units are adjacently disposed in the display panel.

In one embodiment, driving every continuously arranged four columns of the pixel units in a same one of the pixel unit groups by using drive voltages of different polarities includes: in every continuously arranged four columns of the pixel units in the same one of the pixel unit groups, driving a plurality of subpixels in every two columns of the pixel units by using the drive voltages of being not exactly same polarities.

In one embodiment, the driving method further including: dividing each of the pixel unit groups into a plurality of subpixel groups, wherein each of the subpixel groups includes the subpixels arranged in a two-column two-row matrix; and driving every adjacent two of the subpixel groups respectively by using drive voltages of opposite polarities.

In one embodiment, the driving method further including: driving the subpixels in a same one of the subpixel groups by using drive voltages of a same polarity.

In one embodiment, the driving method further including in every two adjacent frame display times, driving a same subpixel by using drive voltages of opposite polarities.

In one embodiment, driving every continuously arranged four columns of the pixel units in a same one of the pixel unit groups by using drive voltages of different polarities includes: in every continuously arranged four columns of the pixel units in the same one of the pixel unit groups, driving a plurality of subpixels in every two columns of the pixel units by using the drive voltages of being not exactly same polarities; and in every two adjacent frame display times, driving a same subpixel by using the drive voltages of opposite polarities.

In one embodiment, each of the pixel units includes red subpixel, a green subpixel and a blue subpixel.

In one embodiment, a number of the subpixels applied with a positive polarity drive voltage of the high voltage level is same as a number of the subpixels applied with a negative polarity drive voltage of a high voltage level.

In one embodiment, for a same subpixel, in every two adjacent frame display times, the drive voltages of different polarities are respectively applied.

A driving device for a display panel, includes a grouping module, configured for dividing a plurality of pixel units of the display panel into a plurality of pixel unit groups, wherein each of the pixel unit groups includes adjacent two rows of the pixel units; and a drive module, including: a first drive unit, configured for driving subpixels in first pixel units and subpixels in second pixel units by using drive voltages of different voltage levels; a second drive unit, configured for driving the subpixels arranged in a same column in every adjacent two of the pixel unit groups by using drive voltages of opposite polarities; and a third drive unit, configured for driving every continuously arranged four columns of the pixel units in a same one of the pixel unit groups by using drive voltages of different polarities. Wherein each of the first pixel units and each of the second pixel units are adjacently disposed in the display panel.

In one embodiment, the third drive unit is further configured for: in every continuously arranged four columns of the pixel units in the same one of the pixel unit groups, driving a plurality of subpixels in every two columns of the pixel units by using the drive voltages of being not exactly same polarities.

In one embodiment, the grouping module is further configured for dividing each of the pixel unit groups into a plurality of subpixel groups, wherein each of the subpixel groups includes the subpixels arranged in a two-column two-row matrix; and the drive module further includes: a fourth drive unit, configured for driving every adjacent two of the subpixel groups respectively by using drive voltages of opposite polarities.

In one embodiment, the drive module further includes: a fifth drive unit, configured for driving the subpixels in a same one of the subpixel groups by using drive voltages of a same polarity.

In one embodiment, each of the pixel units includes a red subpixel, a green subpixel and a blue subpixel.

In one embodiment, a number of the subpixels applied with a positive polarity drive voltage of a high voltage level is same as a number of the subpixels applied with a negative polarity drive voltage of the high voltage level.

In one embodiment, for a same subpixel, in every two adjacent frame display times, the drive voltages of different polarities are respectively applied.

A display device includes a display panel; and a driving device, including a grouping module, configured for dividing a plurality of pixel units of the display panel into a plurality of pixel unit groups, wherein each of the pixel unit groups includes adjacent two rows of the pixel units; and a drive module, including: a first drive unit, configured for driving subpixels in first pixel units and subpixels in second pixel units by using drive voltages of different voltage levels; a second drive unit, configured for driving the subpixels arranged in a same line in every adjacent two of the pixel unit groups by using drive voltages of opposite polarities; and a third drive unit, configured for driving every continuously arranged four columns of the pixel units in a same one of the pixel unit groups by using drive voltages of different polarities; wherein each of the first pixel units and each of the second pixel units are adjacently disposed in the display panel.

In one embodiment, the third drive unit is further configured for: in every continuously arranged four columns of the pixel units in the same one of the pixel unit groups, driving a plurality of subpixels in every two columns of the pixel units by using the drive voltages of being not exactly same polarities.

In one embodiment, the grouping module is further configured for dividing each of the pixel unit groups into a plurality of subpixel groups, wherein each of the subpixel groups includes the subpixels arranged in a two-column two-row matrix; and the drive module further includes: a fourth drive unit, configured for driving every adjacent two of the subpixel groups by using drive voltages of opposite polarities.

In one embodiment, the drive module further includes: a fifth drive unit, configured for driving the subpixels in a same one of the subpixel groups by using drive voltages of a same polarity.

According to the driving method and driving device for a display panel and the display device, the number of the subpixels applied with the drive voltage of positive polarity high voltage level is caused to be equal to the number of the subpixels applied with the drive voltage of negative polarity high voltage level in each row, and the $V_{com}$ voltage is prevented from being affected by stray capacitance, thereby ensuring the accuracy of the image signals, and avoiding a phenomenon of color cast or abnormal picture quality.

BRIEF DESCRIPTION OF THE DRAWINGS

FIG. 3 is a schematic view of drive voltages for respective subpixels in a plurality of pixel units of a display panel of one embodiment.

FIG. 4 is a schematic view of drive voltages for respective subpixels in a plurality of pixel units of a display panel of another embodiment.

FIG. 5*a* is a schematic view of drive voltages for a plurality of pixel units when a display panel of one embodiment displays a particular picture.

FIG. 5*b* is a schematic view of drive voltages for a plurality of pixel units when a display panel of one embodiment displays another particular picture.

FIG. 5*c* is a schematic view of drive voltages for a plurality of pixel units when a display panel of one embodiment displays yet another particular picture.

FIG. 5*d* is a schematic view of drive voltages for a plurality of pixel units when a display panel of one embodiment displays still a further particular picture.

FIG. 5*e* is a schematic view of drive voltages for a plurality of pixel units when a display panel of one embodiment displays one additional particular picture.

FIG. 5*f* is a schematic view of drive voltages for a plurality of pixel units when a display panel of one embodiment displays one additional particular picture.

FIG. 5*g* is a schematic view of drive voltages for a plurality of pixel units when a display panel of one embodiment displays one additional particular picture.

FIG. 5*h* is a schematic view of drive voltages for a plurality of pixel units when a display panel of one embodiment displays one additional particular picture.

DETAILED DESCRIPTION OF PREFERRED EMBODIMENTS

The specific structural and functional details disclosed herein are only representative and are intended for describing exemplary embodiments of the disclosure. However, the disclosure can be embodied in many forms of substitution, and should not be interpreted as merely limited to the embodiments described herein.

In the description of the disclosure, terms used herein are only for illustrating concrete embodiments rather than limiting the exemplary embodiments. Unless otherwise indicated in the content, singular forms "a" and "an" also include plural. Moreover, the terms "comprise" and/or "include" define the existence of described features, integers, steps, operations, units and/or components, but do not exclude the existence or addition of one or more other features, integers, steps, operations, units, components and/or combinations thereof.

For example, a driving method for a display panel includes dividing a plurality of pixel units of the display panel into a plurality of pixel unit groups, wherein each of the pixel unit groups includes adjacent two rows of the pixel units; driving subpixels in first pixel units and subpixels in second pixel units by using drive voltages of different voltage levels; driving the subpixels arranged in a same row in every adjacent two pixel unit groups by using drive voltages of opposite polarities; and driving every continuously arranged four rows of the pixel units in a same one of the pixel unit groups by using drive voltages of different polarities. Wherein each of the first pixel units and each of the second pixel units are adjacently disposed in the display panel.

For example, a driving device for a display panel includes a grouping module, configured for dividing a plurality of pixel units of the display panel into a plurality of pixel unit groups, wherein each of the pixel unit groups includes adjacent two rows of the pixel units; and a drive module, including: a first drive unit, configured for driving subpixels in first pixel units and subpixels in second pixel units by using drive voltages of different voltage levels; a second drive unit, configured for driving the subpixels arranged in a same column in every adjacent two of the pixel unit groups by using drive voltages of opposite polarities; and a third drive unit, configured for driving every continuously arranged four columns of the pixel units in a same one of the pixel unit groups by using drive voltages of different polarities. Wherein each of the first pixel units and each of the second pixel units are adjacently disposed in the display panel.

For example, a display device includes the display device and the driving device thereof.

Figures 1, 2:
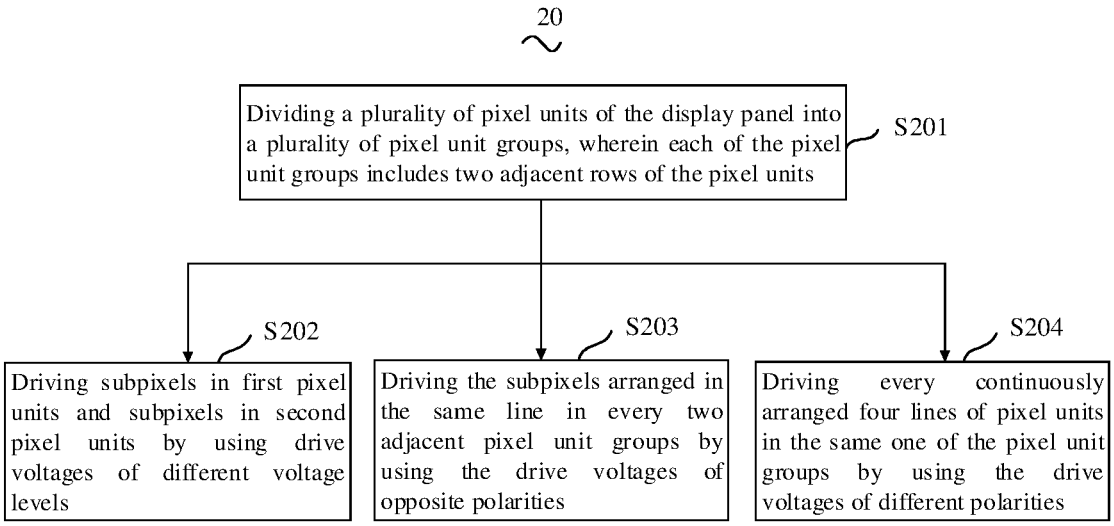
FIG. 1 is a flow schematic view of a driving method for a display panel of one embodiment.
FIG. 2 is a schematic view of drive voltages for a plurality of pixel units of a display panel of one embodiment.

Referring to FIGS. 1 to 3 together, wherein FIG. 1 is a flow schematic view of a driving method for a display panel of one embodiment of the disclosure, and the driving method is configured for the display panel. As shown in FIG. 1, the driving method 20 includes the following steps S201 dividing a plurality of pixel units of the display panel into a plurality of pixel unit groups, wherein each of the pixel unit groups includes adjacent two rows of the pixel units; S202 driving subpixels in first pixel units and subpixels in second pixel units by using drive voltages of different voltage levels; S203 driving the subpixels arranged in a same row in every adjacent two pixel unit groups by using drive voltages of opposite polarities; and S204 driving every continuously arranged four rows of the pixel units in a same one of the pixel unit groups by using drive voltages of different polarities.

In actual application, the steps S202, S203 and S204 may be carried out simultaneously. For example, the drive voltages are applied to respective subpixels in the display panel in display time of a same frame picture respectively, such that levels of the drive voltages for the subpixels in the first pixel units and for the subpixels in the second pixel units are different, the polarities of the drive voltages for the subpixels arranged in the same row in every adjacent two pixel unit groups are opposite, and the polarities of the drive voltages for every continuously arranged four rows of the pixel units in the same one of the pixel unit groups are opposite.

Wherein the different polarities of the drive voltages for every continuously arranged four rows of the pixel units mean that in every continuously arranged four rows of the pixel units, the polarities of the drive voltages for a plurality of subpixels of different pixel units are not exactly same. For example, each pixel unit includes 3 subpixels, then in every continuously arranged four rows of the pixel units, the polarities of the drive voltages for 3 subpixels not in the same row of pixel units are not exactly same. Wherein, the voltages of two opposite polarities are applied to 3 subpixels in each pixel unit, for example, in some pixel units, the drive voltage of the positive polarity is applied to 2 subpixels, and the drive voltage of the negative polarity is applied to 1 subpixel, and in other pixel units, the drive voltage of the negative polarity is applied to 2 subpixels, and the drive voltage of the positive polarity is applied to 1 subpixel. In this way, in every row of pixels of the display panel, a number of the subpixels applied with the positive polarity drive voltage of high voltage level is equal to a number of the subpixels applied with the negative polarity high voltage of high voltage level, and $V_{com}$ voltage is prevented from being affected by stray capacitance, thereby ensuring the accuracy of the image signals, and avoiding a phenomenon of color cast or abnormal picture quality.

Wherein, the row and row in the embodiments of the disclosure represent two mutually perpendicular arrangement directions, for example, the row represents a longitudinal direction, and the row represents a transverse direction. For another example, the row represents the transverse direction, and the row represents the longitudinal direction. That is, the "row" in the embodiments of the disclosure may be the "row" understood by those skilled in the art, and the "row" in the embodiments of the disclosure may be the "row" understood by those skilled in the art.

Specifically, as shown in FIG. 2, the display panel 20 has a plurality of pixel units distributed in a matrix, the plurality of pixel units include a plurality of first pixel units P1 and a plurality of second pixel units P2, the first pixel units and the second pixel units are disposed adjacently, or the first pixel units and the second pixel units are alternately arranged. For example, as shown in FIG. 2, the pixel units adjacent to the first pixel units are all second pixel units, and the pixel units adjacent to the second pixel units are all first pixel units. Specifically, each pixel unit includes a plurality of subpixels, for example, each pixel unit includes a plurality of subpixels of different colors, and for another example, each pixel unit includes three kinds of subpixels of red subpixels R, green subpixels G and blue subpixels B respectively. As shown in FIG. 2, the ith to (i+3)th 4 rows of the pixel units are divided into two pixel unit groups, which are the nth pixel unit group and the (n+1)th pixel unit group, wherein each pixel unit groups includes 2 rows of adjacent pixel units, for example, the nth pixel unit group includes the adjacent ith and (i+1)th rows of the pixel units, and the (n+1)th pixel unit group includes the continuously arranged (i+2)th and (i+3)th rows of the pixel units. Wherein (i, j) represents the ith row and jth row, (i, j+1) represents the ith row and (j+1) row, (i+1, j) represents the (i+1)th row and jth row, and so on.

According to the above driving method, the subpixels in the first pixel units and the subpixels in the second pixel units are driven by the drive voltages of different voltage levels, that is, the drive voltages of different voltage levels are applied to the subpixels in the first pixel units and the subpixels in the second pixel units respectively. For example, the drive voltage of a first voltage level is applied to the subpixels in the first pixel units, and the drive voltage of a second voltage level is applied to the subpixels in the second pixel units. The levels of the drive voltages corresponding to the first pixel units and the second pixel units respectively may be set in advance. For another example, a first drive voltage level corresponding to the first pixel units and a second drive voltage level corresponding to the second pixel units are set in advance. Wherein, in the first drive voltage level and the second drive voltage level, one of them is a high voltage level, and the other is a low voltage level.

For example, the first drive voltage level is higher than the second drive voltage level, or the first drive voltage level is lower than the second drive voltage level.

According to the above method, the drive voltages of opposite polarities are configured for driving the subpixels arranged in the same row in every adjacent two pixel unit groups, and the drive voltages of different polarities are configured for driving every continuously arranged four rows of the pixel units in the same one of the pixel unit groups. That is, the drive voltages of opposite polarities are applied to the subpixels arranged in the same row in every adjacent two pixel unit groups respectively, and the polarities of the drive voltages for every continuously arranged four rows of the pixel units in the same one of the pixel unit groups are enabled to be different. For example, as shown in FIG. 3, the nth pixel unit group and the (n+1)th pixel unit group are adjacent two pixel unit groups, and the drive voltages of opposite polarities are applied to the subpixels, belonging to the nth pixel unit group and the (n+1)th pixel unit group respectively, in the same row, for example, the drive voltage of positive polarity is applied to the R subpixels, belonging to the nth pixel unit group, of the jth row, and the drive voltage of negative polarity is applied to the R subpixels, belonging to the (n+1)th pixel unit group, of the jth row, such that the polarities of the drive voltages for the subpixels in the same row and belonging to the adjacent two pixel unit groups are opposite. For another example, by taking the pixel units from the continuously arranged four rows of jth row to the (j+3)th row in the nth pixel unit group as an example, the drive voltages of positive, positive and negative polarities are applied to the R subpixels, G subpixels and B subpixels of the jth row of pixel units respectively, the drive voltages of negative, positive and positive polarities are applied to the R subpixels, G subpixels and B subpixels of the (j+1)th row of pixel units respectively, the drive voltages of negative, negative and positive polarities are applied to the R subpixels, G subpixels and B subpixels of the (j+2)th row of pixel units respectively, and the drive voltages of positive, negative and negative polarities are applied to the R subpixels, G subpixels and B subpixels of the (j+3)th row of pixel units respectively, such that in every continuously arranged four rows of the pixel units in the same one of the pixel unit groups, the polarities of the drive voltages for the plurality of subpixels of the pixel units not in the same row are not exactly same, that is, the polarities of the drive voltages for every continuously arranged four rows of the pixel units in the same one of the pixel unit groups are different.

Wherein, R1, G1 and B1 represent the red subpixels, green subpixels and blue subpixels in the first pixel units respectively. R2, G2 and B2 represent the red subpixels, green subpixels and blue subpixels in the second pixel units respectively. H represents the first voltage level, L represents the second voltage level, + represents the positive polarity, and − represents the negative polarity. (i, j) represents the ith row and jth row, (i, j+1) represents the ith row and (j+1) row, (i+1, j) represents the (i+1)th row and jth row, and so on. In the present embodiment, the positive polarity refers to that the drive voltage is larger than a preset common voltage $V_{com}$ of the display panel, that is, a voltage difference between the drive voltage and the $V_{com}$ voltage is larger than 0. The negative polarity refers to that the drive voltage is smaller than the common voltage $V_{com}$, that is, a voltage difference between the drive voltage and the $V_{com}$ voltage is smaller than 0.

By adopting above driving method, in each row of pixels of the display panel, the number of the subpixels applied with the drive voltage of a positive polarity high voltage level (H+) is same as the number of the subpixels applied with the drive voltage of a negative polarity high voltage level (H−), and for example, for each row in FIG. 3, there are 3 subpixels representing the positive polarity high voltage level (H+) and 3 subpixels representing the negative polarity high voltage level (H−) respectively. Due to the same number of the subpixels of the positive and negative polarities of the high voltage level, $V_{com}$ voltage is prevented from being affected by stray capacitance, thereby ensuring the accuracy of the image signals, and avoiding a phenomenon of color cast or abnormal picture quality.

In one embodiment, the above driving method further includes dividing each pixel unit group into a plurality of subpixel groups, wherein each subpixel group includes the subpixels arranged in a two-row two-row matrix. As shown in FIG. 3, the 12 rows of subpixels from the jth row to the (j+3)th row of pixel units in the nth pixel unit group may be divided into C11th to C16th subpixel groups, the 12 rows of subpixels from the jth row to the (j+3)th row of pixel units in the (n+1)th pixel unit group may be divided into C21th to C26th subpixel groups, wherein each subpixel group includes 4 subpixels arranged in the two-row two-row matrix. Specifically, the driving method further includes driving every adjacent two subpixels groups by using the drive voltages of opposite polarities respectively, that is, every adjacent two subpixel groups are respectively applied with the drive voltages of the opposite polarities. For example, the drive voltage of the positive polarity is applied to the C11th subpixel group, and then the drive voltage of the negative polarity is applied to the adjacent C12th subpixel group and the C21th subpixel group. Further, the driving method further includes driving respective subpixels in the same subpixel group by using the drive voltages of the same polarity, that is, the drive voltages of the same polarity are applied to the respective subpixels in the same subpixel group. For example, the drive voltage of the positive polarity is applied to the respective subpixels belonging to the C11th subpixel group. In this way, it can be ensured that the polarities of the drive voltages for the subpixels arranged in the same row in every adjacent two pixel unit groups are opposite, and it is also ensured that the polarities of the drive voltages for every continuously arranged four rows of the pixel units in the same one of the pixel unit groups are different, in addition, the polarities of the drive voltages for every other two subpixels in the same row are changed, and frequent wide-range jump of multiple voltages output from the same data row is avoided, thereby avoiding heating of a data drive chip or distortion of voltage signals, and further enhancing a display quality of respective subpixels.

In actual application, when the display panel is a liquid crystal display panel, considering that if a direct current electric field drives liquid crystal pixels, chemical reaction of a liquid crystal material and acceleration of ageing of electrodes are easily caused, and further the service life of the display panel is shortened. Therefore, in one embodiment, in order to protect the liquid crystal material and the electrodes and prolong the service life of the display panel, each subpixel in the display panel is driven by alternating current. Specifically, for the same subpixel, in every adjacent two frame display times, the drive voltages of different polarities are respectively applied to achieve the alternating current drive effect. For example, the driving method further includes in every adjacent two frame display times, driving the same subpixel by using the drive voltages of opposite polarities, or in other words, for each subpixel, in each frame display time, applying the drive voltage opposite to the polarity of the last frame display time. For example, in mth frame display time, the drive voltage as shown in FIG. 3 is applied to some subpixels in the display panel, while in the (m+1)th frame display time, the drive voltage as shown in FIG. 4 is applied to the above some subpixels in the display panel. It can be seen that in the every adjacent two frame display times, the polarity of the drive voltage for the same subpixel is changed, and the level of the drive voltage keeps unchanged.

As an embodiment, when the display panel is driven, for each subpixel, the level of the drive voltage is determined according to the pixel unit to which the subpixel belongs, the polarity of the drive voltage is determined according to the pixel unit group or subpixel group to which the subpixel belongs, further, the drive voltages for respective subpixels are obtained according to image data of respective pixels and the corresponding polarities and levels of the drive voltages, and further the drive voltages are applied to the respective subpixels by data rows.

The above driving method for a display panel is adopted to drive the display panel to respectively display several specific test pictures as shown in FIGS. 5*a*, 5*b*, 5*c*, 5*d*, 5*e*, 5*f*, 5*g* and 5*h*, and in the figures, the subpixels filled with black oblique lines represent that data signals corresponding to the subpixels are dark state signals. By experiment, it is found that there exists no problem of color cast from the flicker picture display of FIGS. 5*a* and 5*b* to the picture display of FIG. 5*h*, the picture of FIG. 5*c* can avoid crosstalk in a horizontal direction, FIG. 5*d* has no problem of color cast, FIG. 5*d* represents the alternately bright/dark displayed picture every other pixel unit, FIG. 5*e* represents the alternately bright/dark displayed picture every other two pixel units, FIG. 5*f* represents the alternately bright/dark displayed picture every other subpixel unit, FIG. 5*g* represents the alternately bright/dark displayed picture every other one row of subpixels, and FIG. 5*h* represents the alternately bright/dark displayed picture every other one row of pixel units. Thus it can be seen that the driving method for a display panel according to the embodiment of the disclosure has better improving effect for color cast.

The embodiment of the disclosure further provides a driving device 60 for a display panel. The display panel has a plurality of pixel units distributed in a matrix, wherein the plurality of pixel units include a plurality of first pixel units and a plurality of second pixel units, the first pixel units and the second pixel units are disposed adjacently, and each pixel unit includes a plurality of subpixels.

Figure 6:
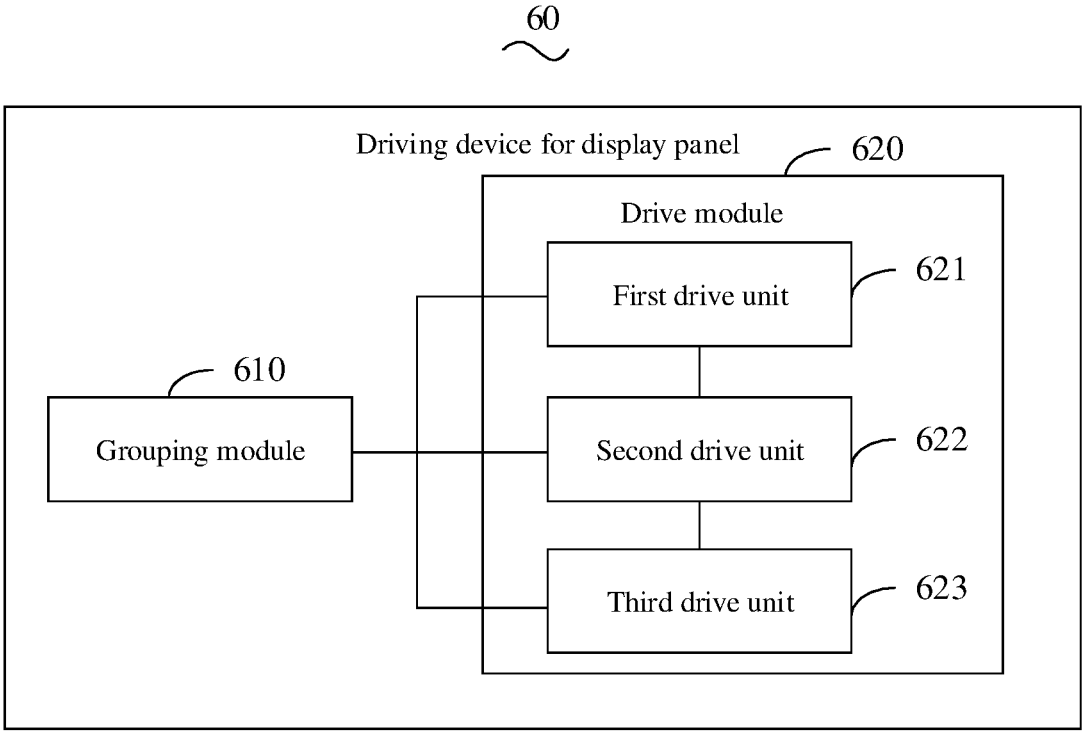
FIG. 6 is a structural schematic view of a driving device for a display panel of one embodiment.

As shown in FIG. 6, the driving device 60 includes a grouping module 610 and a drive module 620, wherein the drive module 620 includes a first drive unit 621, second drive unit 622 and a third drive unit 623. The grouping module 610 is configured for dividing a plurality of pixel units of the display panel into a plurality of pixel unit groups, wherein each of the pixel unit groups includes adjacent two rows of the pixel units. The first drive unit 621 configured for driving subpixels in the first pixel units and subpixels in the second pixel units by using drive voltages of different voltage levels. The second drive unit 622 is configured for driving the subpixels arranged in the same row in every adjacent two pixel unit groups by using the drive voltages of opposite polarities. The third drive unit 623 is configured for driving every continuously arranged four rows of the pixel units in the same one of the pixel unit groups by using the drive voltages of different polarities. For example, the third drive unit is further configured for, in every continuously arranged four rows of the pixel units in the same one of the pixel unit groups, driving a plurality of subpixels in every two rows of the pixel units by using the drive voltages of being not exactly same polarities. Thus, in each row, the number of the subpixels applied with the drive voltage of a positive polarity high voltage level (H+) is same as the number of the subpixels applied with the drive voltage of a negative polarity high voltage level (H−), and the $V_{com}$ voltage is prevented from being affected by stray capacitance, thereby ensuring the accuracy of the image signals, and avoiding a phenomenon of color cast or abnormal picture quality.

Figure 8:
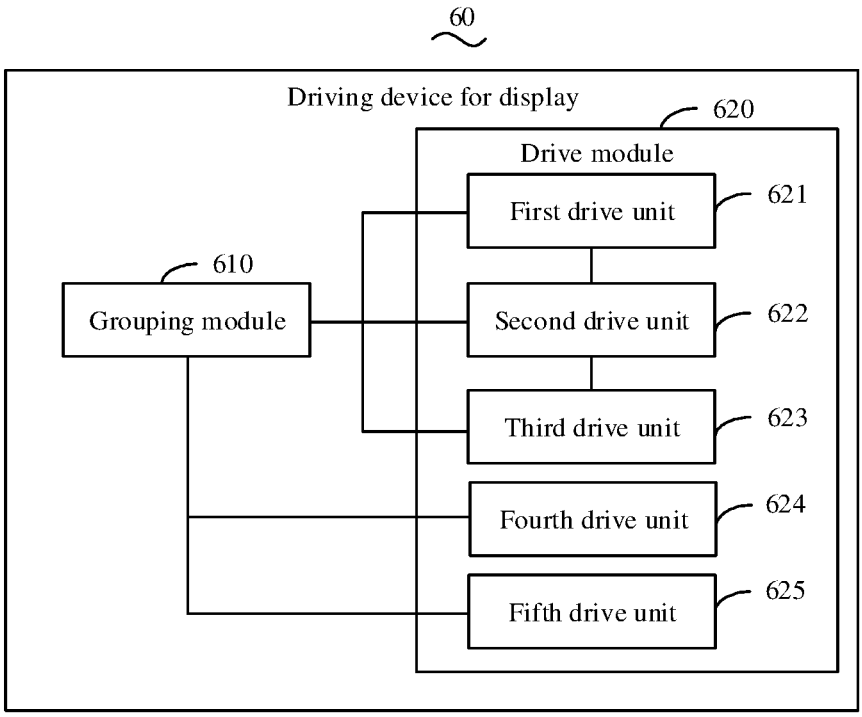
FIG. 8 is a structural schematic view of a driving device for a display panel of another embodiment.

For another example, the grouping module is further configured for dividing each pixel unit group into a plurality of subpixel groups, wherein each subpixel group includes the subpixels arranged in a two-row two-row matrix. As shown in FIG. 8, the drive module further includes a fourth drive unit 624, configured for driving every adjacent two subpixels groups by using the drive voltages of opposite polarities respectively. Further, the drive module further includes a fifth drive unit 625, configured for driving respective subpixels in the same subpixel group by using the drive voltages of the same polarity. In this way, it can be ensured that the polarities of the drive voltages for the subpixels arranged in the same row in every adjacent two pixel unit groups are opposite, and it is also ensured that the polarities of the drive voltages for every continuously arranged four rows of the pixel units in the same one of the pixel unit groups are different, in addition, the polarities of the drive voltages for every other two subpixels in the same row are changed, and frequent wide-range jump of multiple voltages output from the same data row is avoided, thereby avoiding heating of a data drive chip or distortion of voltage signals, and further enhancing a display quality of respective subpixels.

In one of the embodiments, the drive module further includes a sixth drive unit, configured for, in every adjacent two frames display times, alternately applying the drive voltages of opposite polarities to the same subpixel. In this way, the respective subpixels are driven by alternating current, thereby protecting a liquid crystal material and electrodes, and prolonging a service life of the display panel.

In one of the embodiments, the first drive unit is specifically configured for applying the drive voltage of a preset first voltage level to the subpixels in the first pixel units, and applying the drive voltage of a preset second voltage level to the subpixels in the second pixel units. In this way, it can be ensured that the levels of the drive voltages for every adjacent two pixel units are different.

Another embodiment of the disclosure provides a driving device for a display panel, which adopts the driving method for a display panel according to any above embodiment. For example, the driving device for a display panel is implemented by adopting the driving method for a display panel according to any above embodiment. For another example, the driving device for a display panel has function modules corresponding to the driving method for a display panel according to any above embodiment.

The driving method and driving device for a display panel provided by the disclosure may be for example applied to a liquid crystal display panel, an organic light-emitting diode (OLED) display panel, a quantum dot light emitting diodes (QLED) display panel, a curve surface display panel, or a flexible display panel, etc. For another example, the liquid crystal display panel which is taken as the example may be a twisted nematic (TC) liquid crystal display panel, an in-plane switching (IPS) liquid crystal display panel, a plane to row switching (PLS) liquid crystal display panel or a multi-domain vertical alignment (MVA) liquid crystal display panel, etc. Wherein, the above display panel may be driven by adopting a logic board of a full high definition display panel, that is, the above driving method and driving device for a display panel may be implemented by adopting the logic board of a full high definition display panel.

Figure 7:
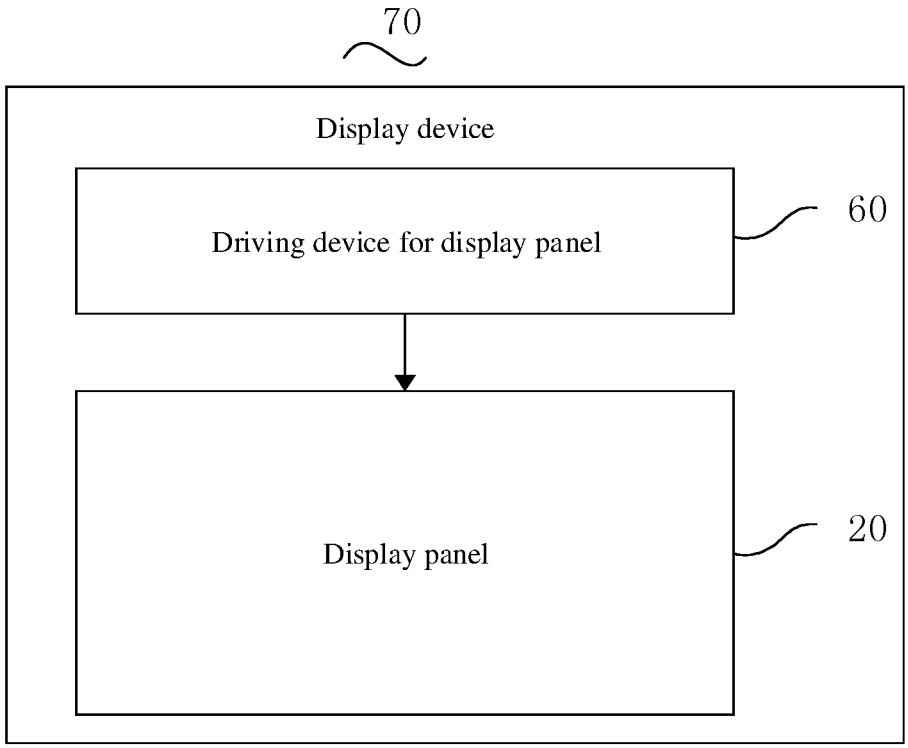
FIG. 7 is a structural schematic view of a display device of one embodiment.

The disclosure further discloses a display device, as shown in FIG. 7, the display device 70 includes a display panel 20 and the driving device 60 for a display panel according to any above embodiment.

For example, the display device is a liquid crystal display device, an OLED display device or a QLED display device, a curve surface display device, a flexible display device, etc. For another example, the liquid crystal display device as the example may be a TN liquid crystal display, an IPS liquid crystal display, a PLS liquid crystal display, or an MVA liquid crystal display, etc.

The foregoing contents are detailed description of the disclosure in conjunction with specific preferred embodiments and concrete embodiments of the disclosure are not limited to these description. For the person skilled in the art of the disclosure, without departing from the concept of the disclosure, simple deductions or substitutions can be made and should be included in the protection scope of the application.

What is claimed is:

1. A driving method for a display panel, the display panel including a plurality of pixel units distributed in rows and columns, and the plurality of pixel units including first pixel units and second pixel units; the driving method comprising dividing the plurality of pixel units of the display panel into a plurality of pixel unit groups, wherein each of the pixel unit groups comprises adjacent two rows of the pixel units;

driving subpixels in the first pixel units and subpixels in the second pixel units by using drive voltages of different voltage levels, and thereby all subpixels in the first pixel units are driven by using the drive voltages of a same voltage level while all subpixels in the second pixel units are driven by using the drive voltages of another same voltage level;

driving the subpixels arranged in a same column in every adjacent two of the pixel unit groups by using drive voltages of opposite polarities, and thereby all subpixels arranged in the same column in one of the every adjacent two of the pixel unit groups are driven by using the drive voltages of a same polarity while all subpixels arranged in the same column in the other one of the every adjacent two of the pixel unit groups are driven by using the drive voltages of another same polarity; and driving every continuously arranged four columns of the pixel units in a same one of the pixel unit groups by using drive voltages of different polarities;

wherein the first pixel units and the second pixel units are disposed alternately in each row as well as in each column in the display panel;

wherein in every adjacent two frame display times, the drive voltage of the same subpixel is changed in polarity while the drive voltage of the same subpixel is kept unchanged in voltage level;

wherein each of the pixel units comprises red subpixel, a green subpixel and a blue subpixel;

wherein a number of the subpixels applied with a positive polarity drive voltage of a high voltage level is same as a number of the subpixels applied with a negative polarity drive voltage of the high voltage level.

2. The driving method according to claim 1, wherein driving every continuously arranged four columns of the pixel units in a same one of the pixel unit groups by using drive voltages of different polarities comprises:

in every continuously arranged four columns of the pixel units in the same one of the pixel unit groups, driving a plurality of subpixels in every two columns of the pixel units by using the drive voltages of being not exactly same polarities.

3. The driving method according to claim 1, further comprising:

dividing each of the pixel unit groups into a plurality of subpixel groups, wherein each of the subpixel groups comprises the subpixels arranged in a two-column two-row matrix; and driving every adjacent two of the subpixel groups respectively by using drive voltages of opposite polarities, and thereby all subpixels in one of the every adjacent two of the subpixel groups are driven by using the drive voltages of a same polarity while all subpixels in the other one of the every adjacent two of the subpixel groups are driven by using the drive voltages of another same polarity.

* * * * *